US008881936B2

(12) United States Patent
Crosby

(10) Patent No.: US 8,881,936 B2
(45) Date of Patent: Nov. 11, 2014

(54) MOLDED PLASTIC CONTAINER

(75) Inventor: Bradley J. Crosby, Omaha, NE (US)

(73) Assignee: Airlite Plastics Co., Omaha, NE (US)

( * ) Notice: Subject to any disclaimer, the term of this patent is extended or adjusted under 35 U.S.C. 154(b) by 173 days.

(21) Appl. No.: 13/396,367

(22) Filed: Feb. 14, 2012

(65) Prior Publication Data

US 2012/0205385 A1 Aug. 16, 2012

Related U.S. Application Data

(60) Provisional application No. 61/442,662, filed on Feb. 14, 2011.

(51) Int. Cl.

| | |
|---|---|
| ***B65D 3/08*** | (2006.01) |
| ***B65D 1/26*** | (2006.01) |
| ***B65D 1/16*** | (2006.01) |
| *B65D 8/12* | (2006.01) |

(52) U.S. Cl.
CPC ... *B65D 1/26* (2013.01); *B65D 1/16* (2013.01)
USPC ..... 220/669; 229/400; 220/675; D7/509

(58) Field of Classification Search
USPC ..... 220/608, 669, 675; 229/400; D7/509, D7/396.2
See application file for complete search history.

(56) References Cited

U.S. PATENT DOCUMENTS

| | | | | | |
|---|---|---|---|---|---|
| D240,286 | S | * | 6/1976 | Sarpaneva | D7/509 |
| D340,385 | S | * | 10/1993 | Durand | D7/509 |
| D424,877 | S | * | 5/2000 | Cayouette | D7/523 |
| D508,372 | S | * | 8/2005 | Martinez-Lopez | D7/509 |
| D527,583 | S | * | 9/2006 | Freeman | D7/523 |
| D536,930 | S | * | 2/2007 | Li | D7/533 |
| D559,039 | S | * | 1/2008 | Freeman | D7/523 |
| D559,040 | S | * | 1/2008 | Freeman | D7/523 |
| D622,548 | S | * | 8/2010 | Jensen et al. | D7/523 |
| D651,452 | S | * | 1/2012 | Hillebrenner et al. | D7/396.2 |
| D659,472 | S | * | 5/2012 | D'Amato | D7/509 |
| D682,088 | S | * | 5/2013 | de Urquijo Carmona | D9/428 |
| 2010/0127005 | A1 | * | 5/2010 | Sanbrook et al. | 220/705 |

* cited by examiner

*Primary Examiner* — Mickey Yu
*Assistant Examiner* — Niki Eloshway
(74) *Attorney, Agent, or Firm* — McAndrews, Held & Malloy, Ltd.

(57) ABSTRACT

A container is disclosed having a top rim, a sidewall, and a bottom panel, wherein the sidewall extends at least from the top rim to the bottom panel, the top rim is generally circular, the bottom panel is generally rectangular, and the sidewall transitions from a circular portion adjacent to the top rim to a generally rectangular portion adjacent to the bottom panel.

9 Claims, 3 Drawing Sheets

MOLDED PLASTIC CONTAINER

CROSS-REFERENCE TO RELATED APPLICATIONS

This application claims the priority of U.S. Provisional Application 61/442,662, filed Feb. 14, 2011, which is hereby incorporated by reference in its entirety.

SUMMARY OF THE INVENTION

An embodiment of the invention is a container having a top rim, a sidewall, and a bottom panel. The sidewall extends at least from the top rim to the bottom panel. The top rim is generally circular, and the bottom panel is generally rectangular. The sidewall transitions from a circular portion adjacent to the top rim to a generally rectangular portion adjacent to the bottom panel.

Another embodiment of the invention is a molded plastic container including a circular top opening, a generally flat bottom panel parallel to and spaced from the top opening, a unitary side panel, and a bottom panel. The circular opening has a circular rim with a first radius R. The unitary side panel has a height H, a top boundary and a bottom boundary. The height H comprises the distance along a perpendicular axis between the bottom panel and the center of the circular top rim.

The container is formed with first and second planes of symmetry at right angles and intersecting each other along the perpendicular axis.

The bottom panel includes first and second pairs of opposite sides. Each adjacent side is joined by an arcuate section having an equal radius at the midpoint thereof $R_3$ then R. The first pair of opposite sides of the bottom panel comprise generally straight, parallel, spaced lines. The second pair of opposite sides comprise arcs having the same radius at the midpoint thereof $R_2$. The radii $R_3$ are less than the radii R. The planes of symmetry intersect the perpendicular axis and the line joining the medians of the opposed straight lines of the first pair of sides of the bottom panel and the perpendicular axis and line joining the medians of the opposed arcuate sides of the second pair of sides of the bottom panel.

The side panel generally comprises a truncated cone formed by panel sections, each said panel section comprising a shaped curved panel section with a generally circular segment top boundary and a bottom boundary coincident with a distinct side of the bottom panel. The opposite panel sections comprise mirror images of each other and are symmetrical with respect to both the first and second planes of symmetry. $R_3<R<R_2$, and every ray of said bottom panel through said perpendicular axis is less than 2R.

Certain optional objects, advantages and features will be set forth in the description which follows.

BRIEF DESCRIPTION OF THE DRAWINGS

In the description which follows, reference will be made to the drawings including the following figures.

DETAILED DESCRIPTION OF AN EMBODIMENT OF THE INVENTION

Figure 1:
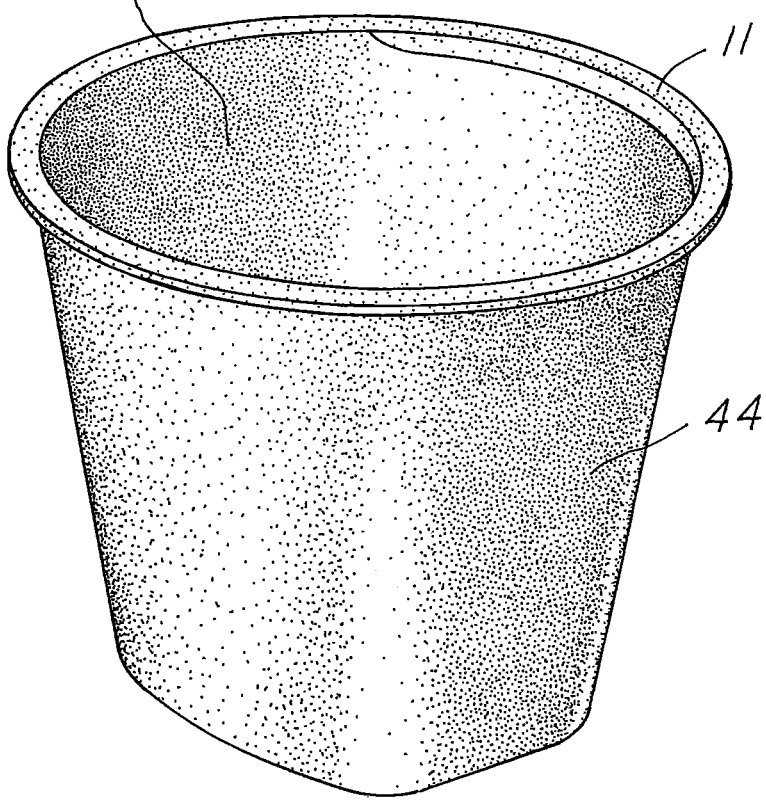
FIG. 1 is an isometric view of a typical molded plastic container made in accord with the present invention.

The present invention comprises a unitary, thin wall, molded plastic container including but not limited to an injection molded container and further including but not limited to an injection molded container having in-mold labeling on the outer or external surface of the container. The container is configured with a circular top opening rim spaced from and parallel to a generally flat bottom panel wherein the bottom panel has a configuration or shape comprised of one pair of opposed, generally straight sides joined with a connecting pair of opposed arcuate sides. Thus the bottom panel has the general configuration a modified rectangle wherein at least one pair of the sides of the modified rectangle is arcuate. Further the bottom panel has a profile which is within the profile of the generally circular top opening. The circular top rim and opening are joined to the bottom panel by a side panel in the form of a uniformly truncated cone. The top circular opening has an outer rim radius R with a perpendicular axis through the center of the plane defined by top opening rim aligned with the center of the bottom panel so that the container and, more particularly, the configuration of the side panel is comprised of a configuration wherein there are two planes of symmetry intersecting at right angles and extending through the perpendicular axis between the top opening rim and the bottom panel.

The bottom panel includes a pair of generally straight sides and a connecting pair of equally arcuate sides. The arcuate sides comprise a compound curve with a center point having a radius $R_2$ which is greater than the radius R of the top circular opening rim. Each of the arcuate sides are joined at their opposite ends to the generally flat sides of the bottom panel by an arcuate section comprising a compound curve having a radius $R_3$ at the midpoint. Thus four arcuate sections having a radius section $R_3$ are employed to join the two generally flat sides and the ends of the arcuate sides of the bottom panel.

The height and volume of the container may be varied. The generally flat bottom panel may include a circumferential foot to slightly elevate the container when it is seated on a flat surface thereby defining a recessed center portion of the bottom panel to accommodate residual plastic material that remains at the location of a sprue and gate at the center of the bottom panel due to the injection molding process. The mold for manufacture of the container may include a circumferential groove bounding the foot for placement and retention of an in-mold label in order to more easily enable the in-mold labeling step during the manufacture of an injection molded plastic container of the type described having included thereon an outer surface product label.

The circular top opening may include a unitary rim section projecting radially outwardly or otherwise appropriately shaped to receive a cover for the container. The side panel which has a generally truncated cone configuration is designed to maximize the container capacity by forming the generally circular top boundary section of the side panel from generally circular segments. The bottom boundary of the side panel is designed to smoothly engage the outer edge of the bottom panel to maximize container capacity.

The configuration and design of the container permits utilization of preexisting packaging machinery engineered and designed to apply circular caps or closures on or over the open top of the container. The configuration of the bottom panel and the side panel enables formation of surfaces having a greater surface area on two sides of the container for appropriate display of product information and product labeling. These two sides are associated with the arcuate sections or pair of arcuate sides of the bottom panel. The opposite generally flat sided sections of the bottom panel provide that the container will have a configuration wherein the container can be easily oriented by product display mechanisms, such as vending machine racks, so that the product labeling is properly oriented with the front of the label facing forward and centered. The container structure also enables the use of product filling machinery wherein orientation of the container is required but wherein a top closure may be easily and efficiently applied by preexisting machinery designed for application of closures or caps onto containers having a circular top opening rim.

A further advantage of the invention is the characteristic that multiple containers may easily nest prior to being filled.

Figure 2:
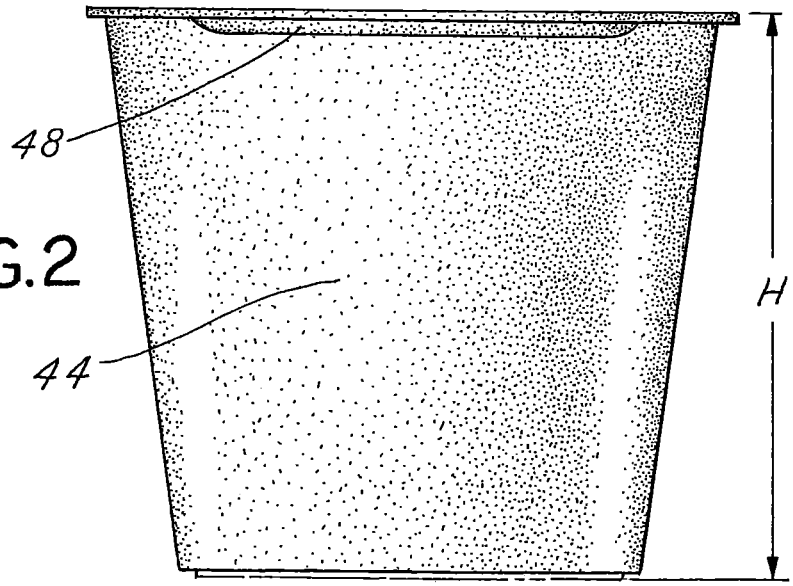
FIG. 2 is a front side view of the container of FIG. 1.
Figure 3:
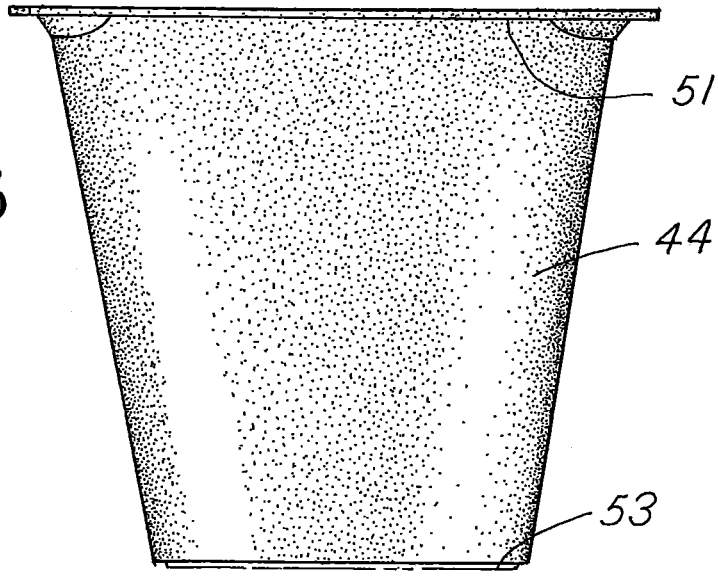
FIG. 3 is a side view of the container of FIG. 1.
Figure 4:
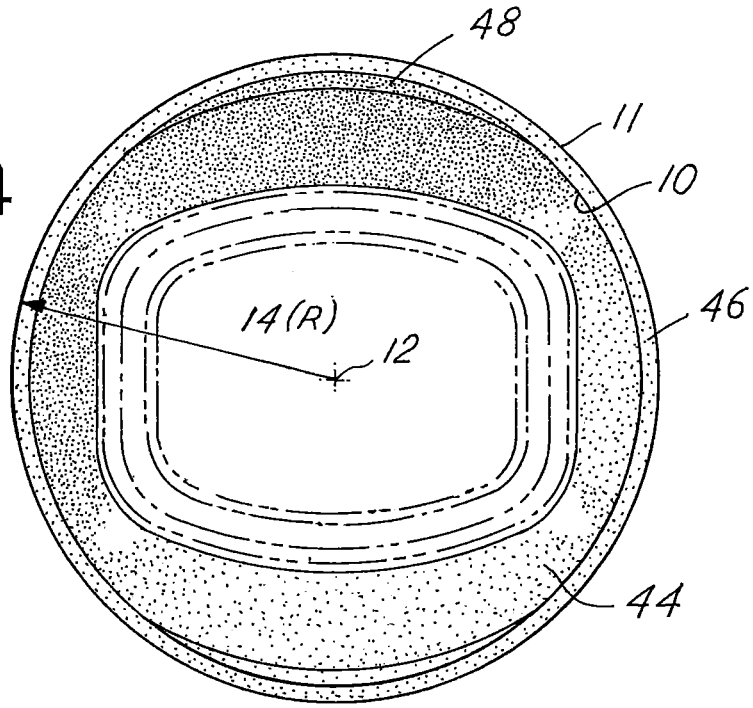
FIG. 4 is a top plan view of the container of FIG. 1.
Figure 5:
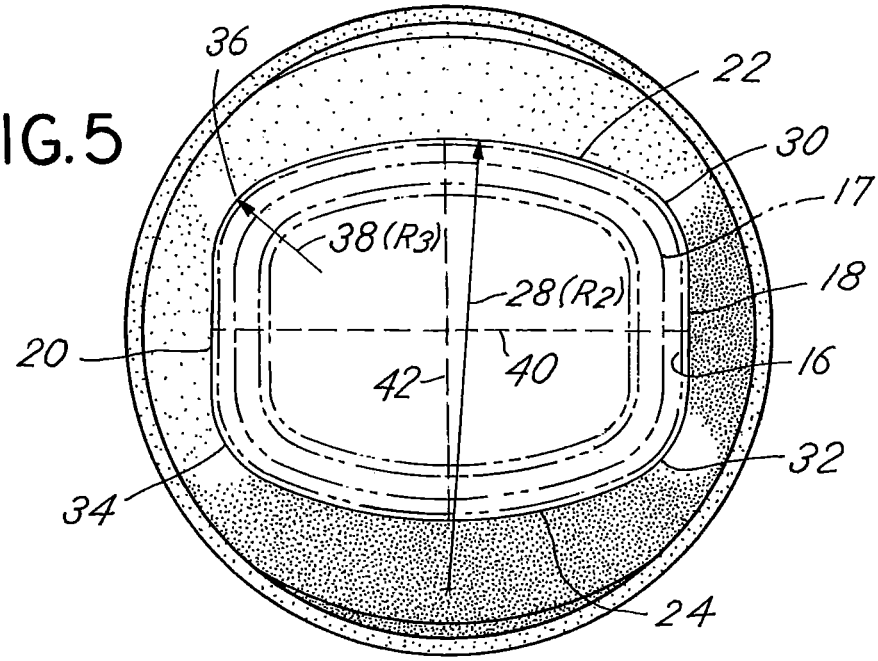
FIG. 5 is a bottom plan view of the container of FIG. 1.

Referring more particularly to FIGS. 1-5, there is illustrated an embodiment of an injection molded plastic container in accord with the invention. The container is molded as a unitary item using injection molding techniques. For example, in the manufacture of a container as depicted in FIGS. 1-5 a mold is comprised of an outer shell which is designed to form the outside surface of the container and an inner shell or cope or insert which is compatible with the outer shell and is designed to form the inner configuration of the container and the top of the container opening end rim. Typically the mold includes a gate for injection of plastic material through a sprue into the assembled mold. Often with respect to a container of the type depicted in FIGS. 1-5 the gate is positioned to provide injection through the center of the bottom of the mold.

Referring further to FIGS. 1-5, the container depicted with an outer rim 11 that includes a top opening 10 is circular in configuration. The opening 10 has a center 12 with a radius 14 of circular rim 11 with a dimension of R. The container further includes a bottom panel 16 which is parallel to and spaced from the top opening 10 by a dimension H. The bottom panel 16 includes a pair of opposed, equal length generally flat sides 18, 20 which are generally parallel to one another and spaced from one another. The bottom panel 16 further includes a second pair of sides 22 and 24 which are each identical arcuate compound or composite curves including sectors of a circle and are opposed mirror images of each other. The outer ends of the first pair of sides 18 and 20 are connected to the outer ends of the second pair of sides 22, 24 to form a boundary of the bottom panel 16. The arcuate sides 22 and 24 have an identical radius 28 ($R_2$) measured at the midpoint of the respective sides 22, 24. The radius $R_2$ is greater than radius R of the rim 11 top opening 10. The opposite ends of the respective pairs of sides; namely, the first pair of sides 18 and 20 and the second pair of sides 22 and 24 are connected by identical arcuate sections 30, 32, 34 and 36. The arcuate sections 30, 32, 34 and 36 all have equal radii 38 ($R_3$) measured at the midpoint of each arcuate compound curve section 30, 32, 34 and 36.

The vertical axis through the center 12 of the opening 10 and perpendicular to the plane of the opening 10 passes through the center of the bottom panel 16. The center of the bottom panel 16 is defined by intersecting lines or rays 40 and 42 which connect respectively the median or midpoint of opposed generally flat sides 18 and 20 and the middle or median of opposed arcuate sides 22 and 24. Note that the radius 28 ($R_2$) in the drawing of FIG. 5 should be coextensive with the line or ray 42. The rays 40 and 42 in combination with the perpendicular axis through the center 12 define first and second perpendicular planes of symmetry with respect to the configuration of the container. Thus, the ray 40 in combination with a center line axis through the center 12 defines a plane of symmetry with respect to the container as does the line or ray 42 and center line axis.

The radii 38 ($R_3$) of the arcuate sections 30, 32, 34 and 36 are in this embodiment equal, and less than the radii of the circular opening R. Thus, in an embodiment the various radii have the following relationship: $R_3$ is less than R which is less than $R_2$. The ratio of R to $R_2$ can range, for example, from 0.65 to 0.85, optionally from 0.7 to 0.8. The ratio of $R_3$ to R can range, for example, from 0.25 to 0.34, optionally from 0.26 to 0.32. The dimensions can be expressed in any unit of measurement, for example inches, cm, or meters.

RADIUS DIMENSION/RATIOS

| TOP R | BOTTOM $R_2$ | CORNER $R_3$ | $R/R_2$ | $R_3/R$ |
|---|---|---|---|---|
| 1.558 | 2.002 | 0.495 | 0.778 | 0.318 |
| 1.558 | 2.000 | 0.495 | 0.779 | 0.318 |
| 2.119 | 3.001 | 0.617 | 0.706 | 0.291 |
| 2.250 | 3.000 | 0.615 | 0.750 | 0.273 |
| 2.300 | 3.001 | 0.617 | 0.766 | 0.268 |
| 2.300 | 3.001 | 0.617 | 0.766 | 0.268 |

Such ratios and dimensions are examples and not limitations. Factors such as container capacity, container height and dimension R may vary significantly and ratios of the dimensions $R/R_2$ and $R_3/R$ may be varied over a wide range to achieve desired objectives. Further, the length of any ray associated with the bottom panel 16 is less than the diameter of the opening 10 or in other words is less than 2 times R so that the profile of the opening includes and overlies the profile of panel 16.

As previously noted the container may include a foot 17 which is circumferential with respect to the boundary of the bottom panel, and in this embodiment is formed into the bottom panel. The side panel 44 is a unitary molded panel inasmuch as the container is preferably molded in a single "shot". The side panel has a truncated generally conical shape and/or a generally frustoconical shape wherein the maximum dimension of the truncated frustoconical configuration comprises the center opening or top opening 10. The side panel 44 top boundary 51 is comprised of curved or circular segments which are joined to form the top opening 10 which, in turn, connects with an optional rim 46. There may be included minor transition segments in the side panel 44 such as the minor transition segment 48 adjacent the top boundary. However, the transition segments are minimized in order to maximize the capacity of the container. Preservation of the generally circular opening 10 and circular rim 11 is an important characteristic with respect the methodology for filling the container with contents in an efficient manner. That is rim 11 and in particular the outer edge thereof or outer face thereof is circular and may or may not define an outward projecting radial lip. This configuration enables efficient attachment of circular lids or closures to the container.

The bottom boundary 53 of side panel 44 engages the outer edge of the bottom panel 16. The side panel 44 is, as mentioned heretofore, symmetrical with respect to the planes of symmetry described resulting in an aesthetic pleasing configuration.

Alternative containers can be formed in accord with the invention. The shape of each container and thus the values and ratios of R, $R_2$, $R_3$, and H can be adjusted to address aesthetic desires that result from the choice of specific configuration. The invention thus accommodates the application of aesthetic criteria to the container.

While certain embodiments of the invention have been provided by way of examples, it is possible to vary the aspects of the invention without departing from the full scope thereof. For example, the height of the container can vary widely. Also the dimensional relationship of the flat sides and arcuate sides of the bottom panel may be varied to some extent, although it is preferred that the profile of the bottom panel fits within the profile of the parallel top opening. The alignment of the top opening in parallel relationship with the bottom panel is preferred but other optional relationships may be employed. The top opening may be slightly skewed for example with respect to the bottom panel though such modification may require altering equipment for filling the container. The invention therefore is to be limited only by the following claims and equivalents thereof.

What is claimed is:

1. A molded plastic container including a circular top opening said circular top opening having a circular top rim with a first radius R;

a generally flat bottom panel parallel to and spaced from the circular top opening;

a unitary side panel having a height H, a top boundary and a bottom boundary; said height H comprising the distance along a perpendicular axis between the bottom panel and the center of the circular top rim; said container formed with first and second planes of symmetry at right angles and intersecting each other along the perpendicular axis said bottom panel having a boundary including first and second pairs of opposite sides, each adjacent side joined by an arcuate section having an equal radius $R_3$ at the midpoint thereof, said first pair of opposite sides of said bottom panel comprising generally straight, parallel; spaced lines and each said second pair of opposite sides comprising an arc having the same radius at the midpoint thereof $R_2$, said planes of symmetry intersecting the perpendicular axis and the line joining the median of the opposed straight lines of the first pair of sides of the bottom panel and the perpendicular axis and line joining median of the opposed arcuate sides of second pair of sides of the bottom panel;

said side panel comprising a truncated cone formed by panel sections, each said panel section comprising a shaped curved panel section with a generally circular segment top boundary and a bottom boundary coincident with a distinct side of the bottom panel, said opposite panel sections comprising mirror images of each other and symmetrical with respect to both the first and second planes of symmetry; wherein $R_3<R<R_2$; and wherein said bottom panel defines rays respectively extending from each point on the boundary, through said perpendicular axis, to an opposed point on the boundary, wherein the length of each said ray is less than 2R.

2. The container of claim 1 wherein the rim is generally a flat, coplanar rim perpendicular to the perpendicular axis and extending radially outwardly from the generally circular opening at the top boundary of the side panel.

3. The container of claim 1 wherein the side panel includes an outside surface and further including an in-mold label on the outside surface of the side panel.

4. The container of claim 1 wherein the ratio of R to $R_2$ is from 0.65 to 0.85.

5. The container of claim 1 wherein the ratio of R to $R_2$ is from 0.7 to 0.8.

6. The container of claim 1 wherein the ratio of $R_3$ to R is from 0.25 to 0.34.

7. The container of claim 1 wherein the ratio of $R_3$ to R is from 0.26 to 0.32.

8. The container of claim 1 wherein the ratio of R to $R_2$ is from 0.65 to 0.85 and the ratio of $R_3$ to R is from 0.25 to 0.34.

9. The container of claim 1 wherein the ratio of R to $R_2$ is from 0.7 to 0.8 and the ratio of $R_3$ to R is from 0.26 to 0.32.

* * * * *